US007662026B2

(12) United States Patent
Lewis

(10) Patent No.: US 7,662,026 B2
(45) Date of Patent: Feb. 16, 2010

(54) VALVE GASKET SEALING SURFACE REFURBISHING METHODS AND SYSTEMS

(75) Inventor: Jeffrey Alan Lewis, Evans, CO (US)

(73) Assignee: Matheson Tri-Gas, Inc., Basking Ridge, NJ (US)

( * ) Notice: Subject to any disclaimer, the term of this patent is extended or adjusted under 35 U.S.C. 154(b) by 118 days.

(21) Appl. No.: 11/679,757

(22) Filed: Feb. 27, 2007

(65) Prior Publication Data

US 2007/0218820 A1 Sep. 20, 2007

Related U.S. Application Data

(60) Provisional application No. 60/779,316, filed on Mar. 3, 2006.

(51) Int. Cl.
*B24B 19/00* (2006.01)

(52) U.S. Cl. ..... 451/28; 451/51; 451/63; 451/430; 451/439; 451/550; 451/558; 408/83.5

(58) Field of Classification Search ..... 451/28, 451/51, 63, 359, 430, 439, 550, 548, 558; 408/83.5

See application file for complete search history.

(56) References Cited

U.S. PATENT DOCUMENTS 1,075,198 A * 10/1913 Crockatt ..... 408/83.5
1,268,617 A * 6/1918 Reed ..... 451/430
1,636,560 A * 7/1927 Hall ..... 451/430
2,180,640 A * 11/1939 Mikalson ..... 451/439
2,830,500 A * 4/1958 Schultis ..... 408/137
4,237,660 A * 12/1980 Fontenot, Sr. ..... 451/430
4,286,903 A * 9/1981 Eckendorff ..... 408/83.5
4,460,009 A * 7/1984 Nanci et al. ..... 137/243.6
4,465,091 A * 8/1984 Keller ..... 137/243.6
4,833,835 A * 5/1989 Van Buren ..... 451/430
6,042,456 A * 3/2000 Foster ..... 451/51
2004/0137738 A1 * 7/2004 Kane et al. ..... 438/690

* cited by examiner

*Primary Examiner*—Eileen P. Morgan
(74) *Attorney, Agent, or Firm*—Townsend and Townsend and Crew LLP

(57) ABSTRACT

In one embodiment, a device to resurface a sealing surface of a fluid connector in a fluid delivery component is provided. The device may include a housing adapted to be reversibly coupled to the fluid connector. Included may be an arbor which is at least partially disposed in the housing, and both rotationally and axially movable within the housing. The arbor may have a first end proximal to the sealing surface and a second distal end adapted to receive rotational actuation. A resurfacing head may be positioned at the first end of the arbor, and may have a resurfacing face that includes a circular resurfacing groove adapted to fit a circular ridge on the sealing surface of the connector. Rotational contact between the groove and the ridge may cause the resurfacing of the sealing surface. The housing may keep the resurfacing head and the sealing surface aligned during the resurfacing.

67 Claims, 12 Drawing Sheets

VALVE GASKET SEALING SURFACE REFURBISHING METHODS AND SYSTEMS

PRIORITY CLAIM

This application claims priority to Provisional U.S. Patent Application No. 60/779,316 filed Mar. 3, 2006, entitled "VALVE GASKET SEALING SURFACE REFURBISHING METHODS AND SYSTEMS," the entire disclosure of which is hereby incorporated by reference as if fully set forth herein.

BACKGROUND OF THE INVENTION

Typically, fluid sources and fluid devices are connected to each other using various connectors. Often these connectors use gaskets to complete a seal between sealing surfaces on mating connectors. The gaskets are usually softer than the connectors, so as to cause some deformation of the gasket when two connectors are mated. This deformation causes the gasket to fill any discontinuities in the sealing surface which might provide an opportunity for the fluid to leak at the connection.

Various types of connectors and gaskets are used in the art. Some connections are made from two connectors with flat sealing surfaces and a washer shaped disk gasket inserted between the two flat sealing surfaces. In certain applications, however, more advanced sealing mechanisms are required due to the specific properties of certain types of fluids delivered from the fluid sources to the fluid devices.

In some advanced sealing mechanisms, the sealing surfaces of connectors are not flat, but contain a circular ridge surrounding the orifice on the sealing surface. Two connectors with such sealing surfaces can be mated together with a toroidal-shaped gasket in between them. For example, VCR-type fittings from the Swagelok Company of Solon, Ohio, and DISS-type fittings defined by the Compressed Gas Association include a toroidal sealing gasket (typically made of metal) that gets pressed into ridges on one or both sides of the sealing surfaces of the connectors. The gaskets in these mechanisms deform around the circular ridges to complete the seal at the connection. Those skilled in the art will recognize that if the ridges on the sealing surface are damaged, they may not form a complete seal between the connectors.

The ridges in such sealing surfaces may be damaged under a variety of circumstance including incorrect coupling of the connectors, perhaps without using gaskets, or merely by the corrosive nature of the fluids used in systems involved. Repair of these connectors often requires removing them from the equipment and sending them to an off-site machine shop to be refurbished. The resulting downtime for the equipment, which may be used to fabricate materials, parts, devices, etc., can be very disruptive and costly to a business.

BRIEF SUMMARY OF THE INVENTION

In one embodiment, a tool to resurface a sealing surface of a fluid connector in a fluid delivery component is provided. The tool may include a housing adapted to be reversibly coupled to the fluid connector. Also included may be an arbor which may be at least partially disposed in the housing, and both rotationally and axially movable within the housing. The arbor may have a first end proximal to the sealing surface and a second end distal to the sealing surface and adapted to receive a rotational actuation source. A resurfacing head may be positioned at the first end of the arbor, and may have a resurfacing face that includes a circular resurfacing groove adapted to fit a circular ridge on the sealing surface of the fluid connector. Rotational contact between the groove and the ridge may cause the resurfacing of the sealing surface. The housing may keep the circular resurfacing groove and the circular ridge on the sealing surface aligned during the resurfacing.

In another embodiment, a different tool to resurface a sealing surface of a fluid connector in a fluid delivery component is provided. The tool may include a housing adapted to be reversibly coupled to the fluid connector. Also included may be an arbor which may be at least partially disposed in the housing, and both rotationally and axially movable within the housing. The arbor may have a first end proximal to the sealing surface and a second end distal to the sealing surface and adapted to receive a rotational actuation source. A resurfacing head may be positioned at the first end of the arbor, and may have a resurfacing face adapted to contact the sealing surface of the fluid connector. Rotational contact between the resurfacing face and the sealing surface may cause the resurfacing of the sealing surface. The tool may also include at least one force producing element. The force producing element or elements may be coupled with the housing and the resurfacing head and be configured to urge the resurfacing head toward the sealing surface. The housing may keep the resurfacing head and the sealing surface aligned during the resurfacing.

In another embodiment, a method of resurfacing a sealing surface of a fluid connector in a fluid delivery component is provided. The method may include coupling the fluid connector to a resurfacing tool including a rotatable resurfacing face that has a circular resurfacing groove adapted to contact a circular ridge on the sealing surface of the fluid connector. The method may further include moving the resurfacing face towards the sealing surface. Finally, the method may rotate the resurfacing groove against the ridge on the sealing surface to cause the sealing surface to be resurfaced. The groove and the ridge may be kept aligned by the resurfacing tool.

Additional embodiments and features are set forth in part in the description that follows, and in part will become apparent to those skilled in the art upon examination of the specification or may be learned by the practice of the invention. The features and advantages of the invention may be realized and attained by means of the instrumentalities, combinations, and methods described in the specification.

BRIEF DESCRIPTION OF THE DRAWINGS

The present invention is described in conjunction with the appended figures.

Figure 1:
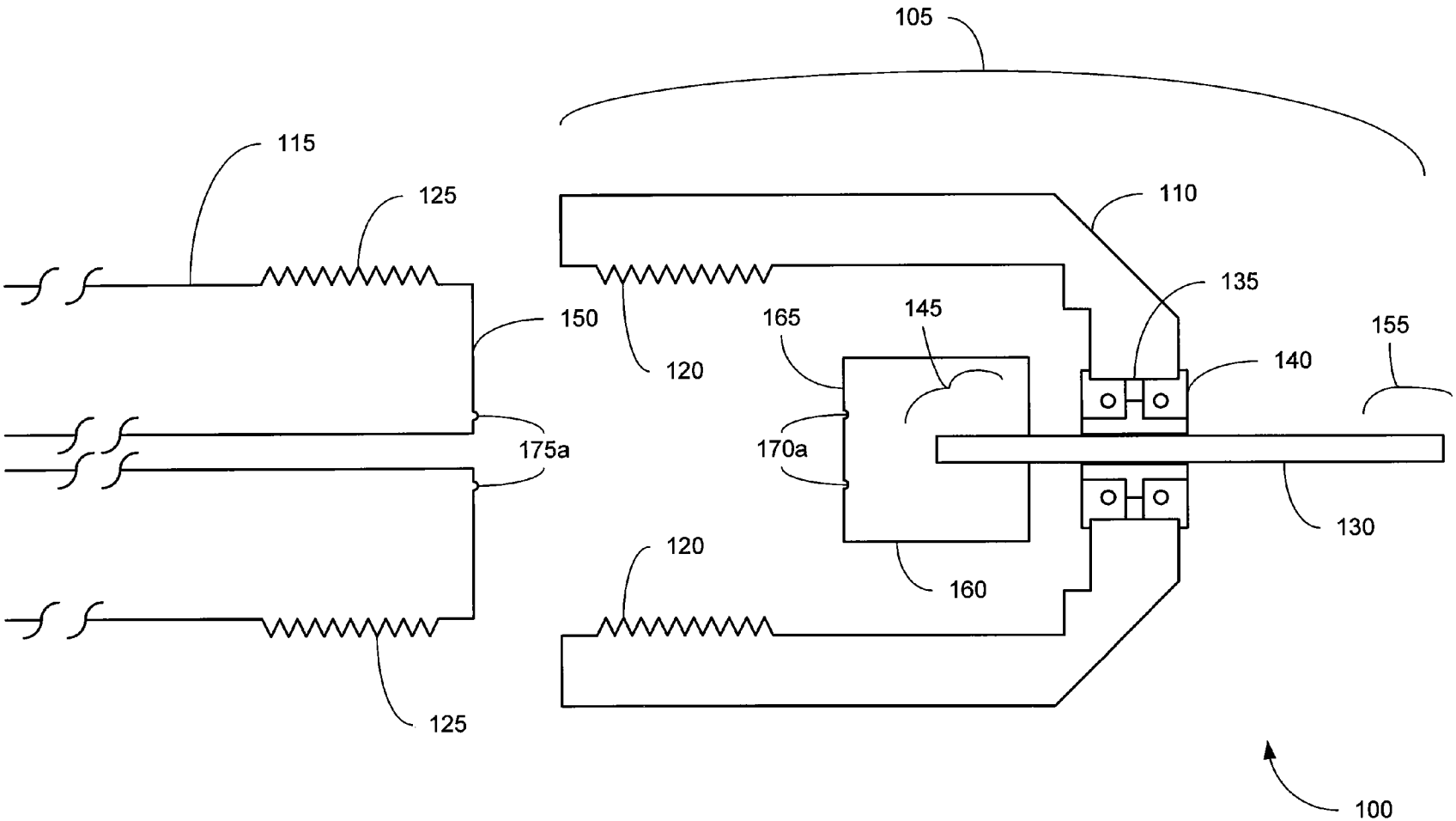
FIG. 1 shows a cross section of one possible tool embodiment of the invention and a fluid connector with a sealing surface that has a circular ridge.

In the appended figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION OF THE INVENTION

Tools are described for resurfacing a sealing surface of a fluid connector in a fluid delivery component. The fluid delivery component may, for example, be a pipe, a tube, a cylinder valve, a coupling, or a manifold. The fluid connector may be used to couple the fluid delivery component to another fluid delivery component and form a leak-tight seal between the components. For example, a fluid connector on a gas storage tank may be coupled to a complementary connector on a gas distribution manifold. A gasket may be compressed between the two fluid connectors when they are coupled together and, when compressed, a then deformed part of the gasket may fill any void where a leak between the couplings could occur.

The shape and smoothness of sealing surfaces on the fluid connectors are therefore critical to creating leak-tight seals between the connectors. If a sealing surface has been distorted or roughened due to corrosion, physical impact or other actions that render the sealing surfaces incapable of forming a conventional seal, even a gasket being compressed and deformed between the connectors may not be able to seal discontinuities on the damaged surface.

Distortion or roughing of the sealing surface can sometimes occur through operator error or misuse of the fluid connectors. Tools used to couple connectors together, such as wrenches, may impact a sealing surface when two fluid connectors are separated causing distortion and roughing. Distortion of the sealing surface may also occur when a gasket is not placed between mated sealing surfaces. It may also occur when the gasket is used multiple times and becomes worked hardened, or when particles get trapped between the gasket and the surface. In these situations and others, a force that would normally deform the gasket between the sealing surfaces can cause damage to one or both of the sealing faces. In additional situations, the corrosive nature of the fluid being moved through the connectors can cause corrosion to a sealing surface. In some instances, disconnecting and exposing the connector surfaces to atmospheric gases (e.g., oxygen, moisture) following an operation may cause the corrosion.

The tools described herein may be used to resurface these sealing surfaces and return the fluid connectors having these surfaces to a serviceable state. By resurfacing a sealing surface, the shape and smoothness of the sealing surface is returned to a state where it may again provide a leak-tight seal between components. In some cases, the sealing surface can be resurfaced, reshaped, and smoothed such that the resulting surface provides a lower leak rate than was achieved by the new connector. Embodiments include refurbishing a sealing surface (e.g., reshaping, resurfacing, and/or smoothing the surface) such that the refurbished surface may have a lower leak rate than a sealing surface of a new connector.

One tool may include a housing adapted to be reversibly coupled to the fluid connector. Threaded or cam couplings are two of a number of possible mechanisms that may be used to adapt the housing to be reversibly coupled to the fluid connector. Also included in the tool may be an arbor which may be at least partially disposed in the housing, and both rotationally and axially movable within the housing.

In some embodiments the housing may be a single piece, and the arbor may only be disposed in the single piece housing, and not in any other elements similar to a housing. These embodiments may provide the advantage of limited pressure on the arbor, wherein such pressure could cause the arbor to be less perpendicular to the fluid connector's face as discussed below. In these or other embodiments, the housing may define at least one bearing cavity, and bearings may be at least partially disposed within the bearing cavities. The arbor may, in turn, be disposed within the bearings. Embodiments with bearings may provide the advantage of lessened wear on non-commercially available parts, such as the housing. The bearing cavities could be sized in certain embodiments to use commercially available bearings, making repair or reconstruction more economical.

The arbor may have a first end proximal to the sealing surface and a second end distal to the sealing surface and adapted to receive a rotational actuation source. The rotational actuation source may, for example, be an electric motor, a pneumatic motor, or a hydraulic motor. In many embodiments, a hand-held drill plugged into a conventional wall outlet may provide the rotational actuation source. Other rotational actuation sources may also be used, such as a manually powered crank arm.

A resurfacing head may be positioned at the first end of the arbor, and may have a resurfacing face that includes a circular resurfacing groove adapted to fit a circular ridge on the sealing surface of the fluid connector. The circular resurfacing groove and the circular ridge on the sealing surface may have a number of matching cross sections. For example, the cross section of both the resurfacing groove and the ridge on the sealing surface may be semi-circular or triangular.

The resurfacing head may have a resurfacing face made from one or more abrasive substances. These substances may include aluminum oxide, ceramic aluminum oxide, zirconia alumina, silicon carbide, cubic boron nitride, and/or diamond, among other abrasive substances (or combinations of substances) used in the resurfacing face. These substances may also be incorporated as additives embedded into the resurfacing head. In some embodiments, the entire resurfacing head may be made from an abrasive substance. Typical particle sizes in the abrasives used may be between about 1 nanometer and about 1 millimeter and/or about 40 grit to about 2000 grit (e.g., about 100 grit to about 2000 grit). The typical hardness of the abrasive used may be between about 1 and 10 on the original Mohs Scale of hardness (e.g., about 5 to about 10 on the Mohs scale).

The resurfacing head may be formed as an integral part of the arbor. Alternatively, the resurfacing head may be reversibly coupled to the arbor. Common mechanisms, known in the art, may be used to couple a reversibly coupleable resurfacing head to the arbor, including using an arbor with a stepped-down threaded end and a nut that locks the resurfacing head to the arbor between the step-down and the nut, or a washer mated with the nut. In these configurations, the attachment mechanism should not interfere with the function of the resurfacing head and resurfacing face.

The resurfacing head may be coupled to the proximal end of the arbor, which is also coupled to the rotational actuation source at its distal end. Rotational force is transferred from the actuation source to the resurfacing head through the arbor. Rotational contact between a groove on the resurfacing head and a ridge on the sealing surface of the connector causes a resurfacing of the sealing surface. The housing keeps the circular resurfacing groove and the circular ridge on the sealing surface aligned during the resurfacing. In some embodiments a polishing material may be deposited on either the sealing surface or the resurfacing face, or both, during resurfacing operations. Depositing a polishing material may provide a smoother finished surface on the sealing surface.

Additional embodiments of the resurfacing tool are also contemplated. For example, the tool may include a housing adapted to be reversibly coupled to the fluid connector. Also, an arbor may be at least partially disposed in the housing, and both rotationally and axially movable within the housing.

The arbor may have a first end proximal to the sealing surface and a second end distal to the sealing surface and adapted to receive a rotational actuation source. A resurfacing head may be positioned at the first end of the arbor, and may have a resurfacing face adapted to contact the sealing surface of the fluid connector. Rotational contact between the resurfacing face and the sealing surface causes the resurfacing of the sealing surface. The sealing surface of the fluid connector may be formed with a circular ridge that is pressed into a gasket in some applications. In these instances, the resurfacing face of the tool may have a circular groove that is adapted to fit the circular ridge when the resurfacing face contacts the sealing surface. In additional instances, the resurfacing face of the tool may have any shape consistent with the shape of the sealing surface.

The tool may also include at least one force producing element. The force producing element or elements may be coupled with the housing and the resurfacing head and be configured to urge the resurfacing head toward the sealing surface. The housing may keep the resurfacing head and the sealing surface aligned during the resurfacing. The force producing elements may be realized by a variety of devices or mechanisms. For example, the force producing elements may include pressurized pneumatic cylinders, pressurized hydraulic cylinders, helical compression springs, and/or helical tension springs, among other types of force producing elements.

A rotational actuation source may also provided. This rotational actuation source may be coupled to the distal end of the arbor and cause the resurfacing head to rotate when activated. The force producing elements described above may be coupled with the housing and the rotational actuation source, which when fixedly coupled with the arbor, will urge the resurfacing head on the proximal end of the arbor toward the sealing surface. The housing and the rotational actuation source may be coupled with each other such that the rotational actuation source may only move relative to the housing in a direction substantially perpendicular to the sealing surface. Typical rotational actuation sources use in some embodiments may have rotational speeds of about 0.1 rotation per minute ("RPM") to about 100,000 RPM (e.g., about 20 rpm to about 40,000 rpm).

Embodiments also include methods of resurfacing a sealing surface of a fluid connector in a fluid delivery component. These methods may include coupling the fluid connector to a resurfacing tool including a rotatable resurfacing face that has a circular resurfacing groove adapted to contact a circular ridge on the sealing surface of the fluid connector. The methods may further include moving the resurfacing face towards the sealing surface. The methods may still further include rotating the resurfacing groove against the ridge on the sealing surface to cause the sealing surface to be resurfaced. The groove and the ridge may be kept aligned by the resurfacing tool.

Turning now to FIG. 1, a block diagram cross section 100 of one possible tool embodiment of the invention and a fluid connector with a sealing surface that has a circular ridge is shown. The tool 105 consists of a housing 110. The housing 110 is reversibly coupleable to a fluid connector 115 due to machine threads 120 on the tool 105 and machine threads 125 on the fluid connector 115. The tool 105 is further made up of an arbor 130 that is disposed within the housing 110. In this embodiment, the housing 110 defines a bearing cavity 135, and a bearing 140 is disposed in the bearing cavity 135.

The arbor 130 has a first end 145 proximal to a sealing surface 150 on the fluid connector 115. A second end 155 of the arbor 130 is distal to the sealing surface 150. The second end 155 of the arbor 130 is adapted to receive a rotational actuation source (not shown on FIG. 1) as described above.

A resurfacing head 160 is positioned at the first end 145 of the arbor 130. The resurfacing head 160 has a resurfacing face 165 that includes a circular resurfacing groove 170*a* adapted to fit a circular ridge 175*a* on the sealing surface 150 of the fluid connector 115. The resurfacing groove 170*a* and the circular ridge 175*a* are shown in FIG. 1 as having a semi-circular cross section, though other cross section are possible within the scope of the invention.

When practicing one method of the invention, the tool 105 would be coupled to the fluid connector 115 using the machine threads 120, 125 on the tool and the fluid connector. As discussed above, fluid connector 115 may, by way of example, be a pipe, tube, cylinder valve, line valve, gas distribution component, coupling or manifold. Once coupled, the housing, 110 may keep the resurfacing head 160, resurfacing face 165, and the circular resurfacing groove 170*a* aligned with the sealing surface 150 and the circular ridge 175*a* on the sealing surface. The arbor 130 may then receive a rotational actuation source at the second end 155. When the rotational actuation source is activated, and the arbor 130 is moved axially through the housing 110 and bearings 135 toward the sealing surface 150, the resurfacing face 165 and resurfacing groove 170*a* will resurface the circular ridge 175*a* on the sealing surface 150. A polishing material, as described above, may be deposited on either the sealing surface 150 or the resurfacing face 165 to achieve an even smoother surface finish.

Figure 1A:
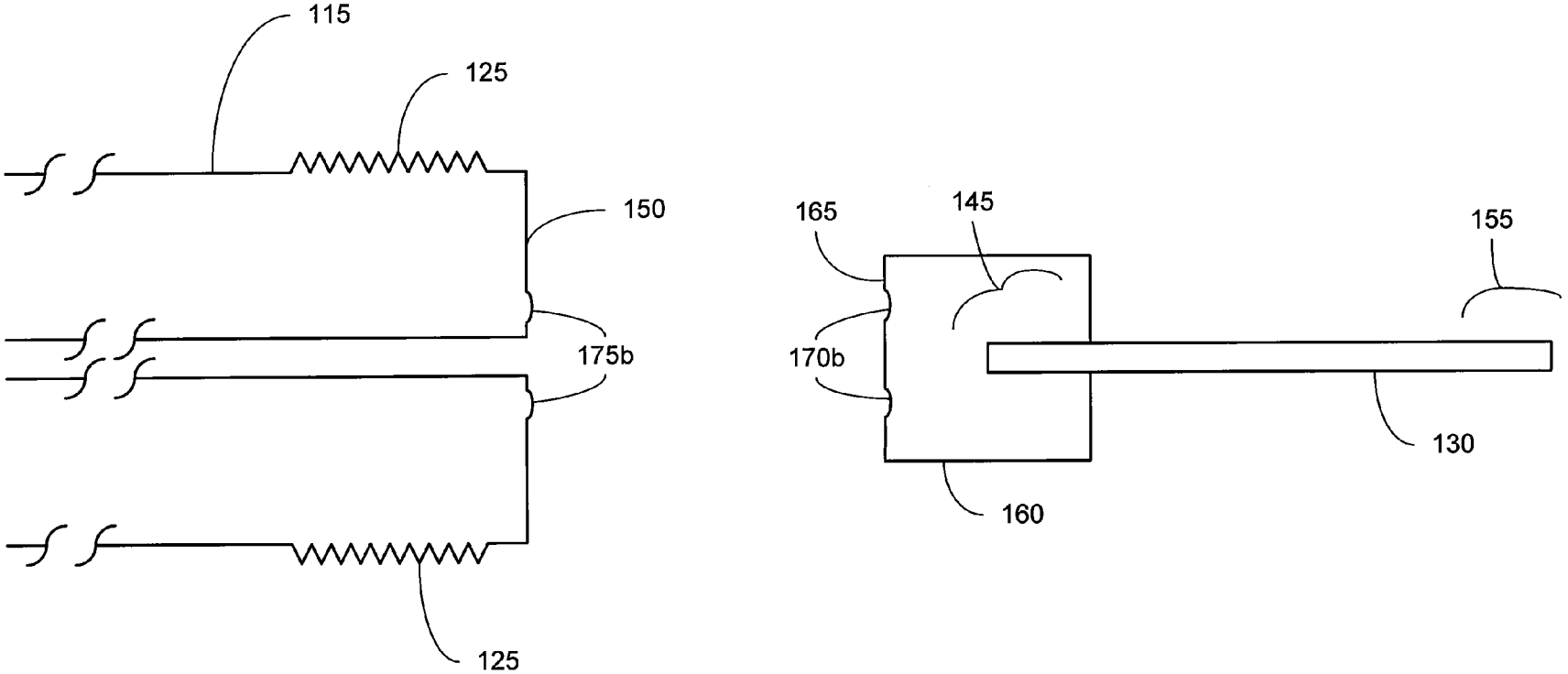
FIG. 1*a* shows a cross section of a sealing surface with a semi-elliptical cross sectioned ridge and a matching resurfacing head.
Figure 1B:
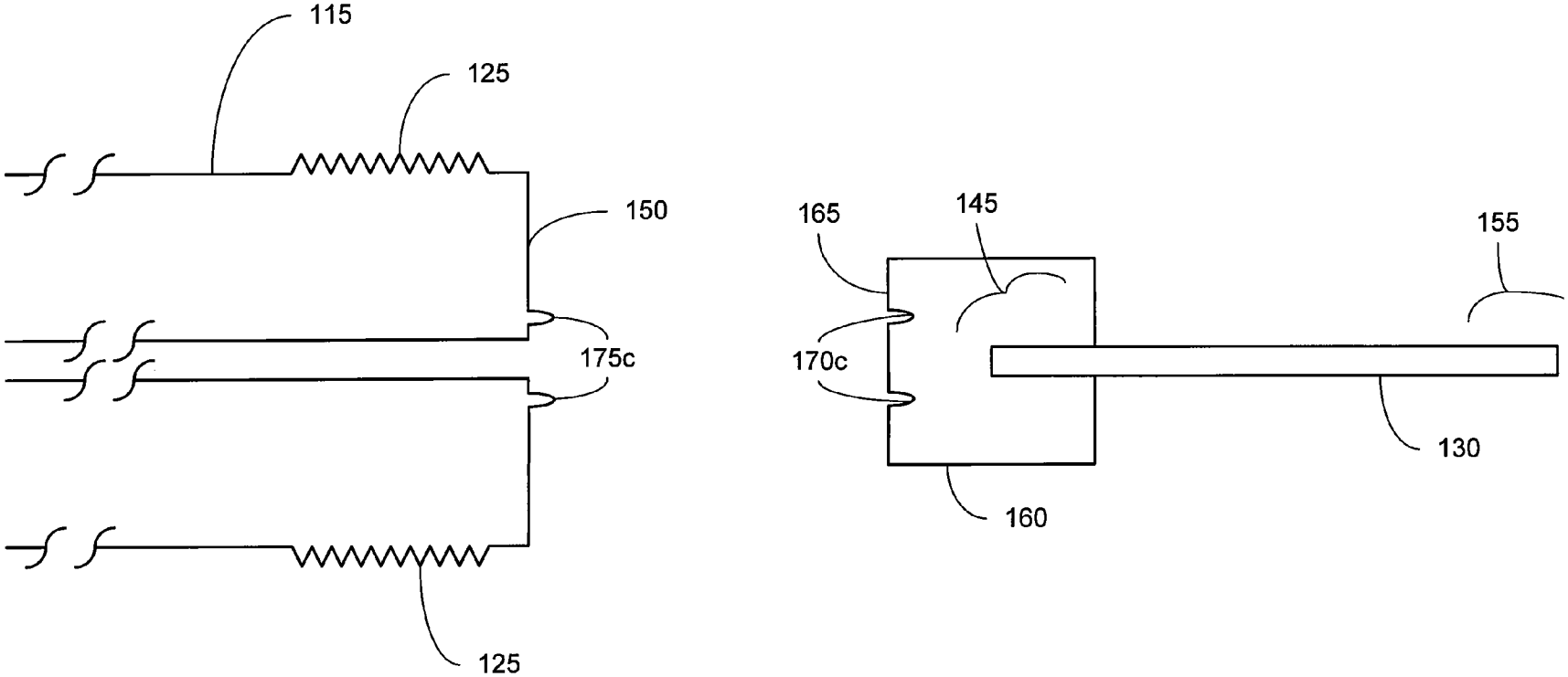
FIG. 1*b* shows a cross section of a sealing surface with a different semi-elliptical cross sectioned ridge and a matching resurfacing head.
Figure 1C:
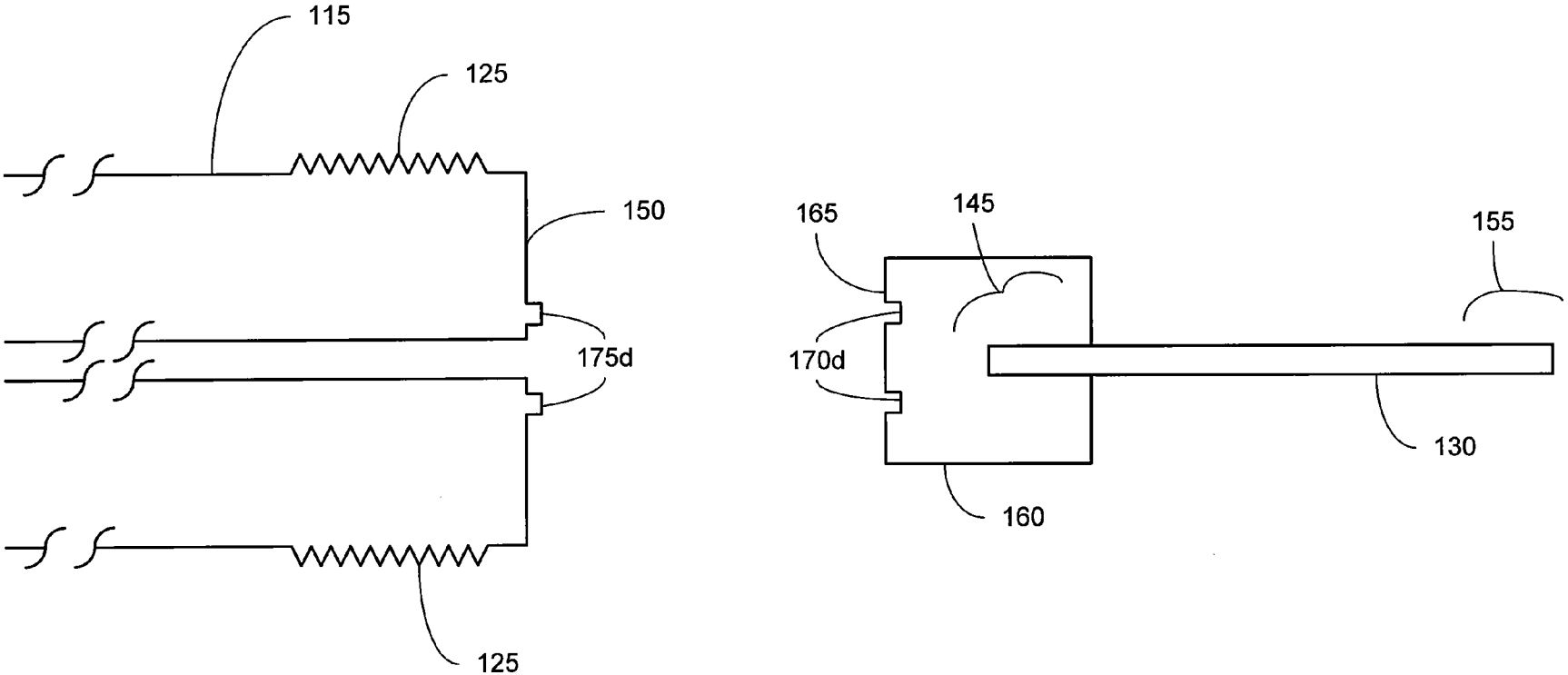
FIG. 1*c* shows a cross section of a sealing surface with a rectangular cross sectioned ridge and a matching resurfacing head.
Figure 1D:
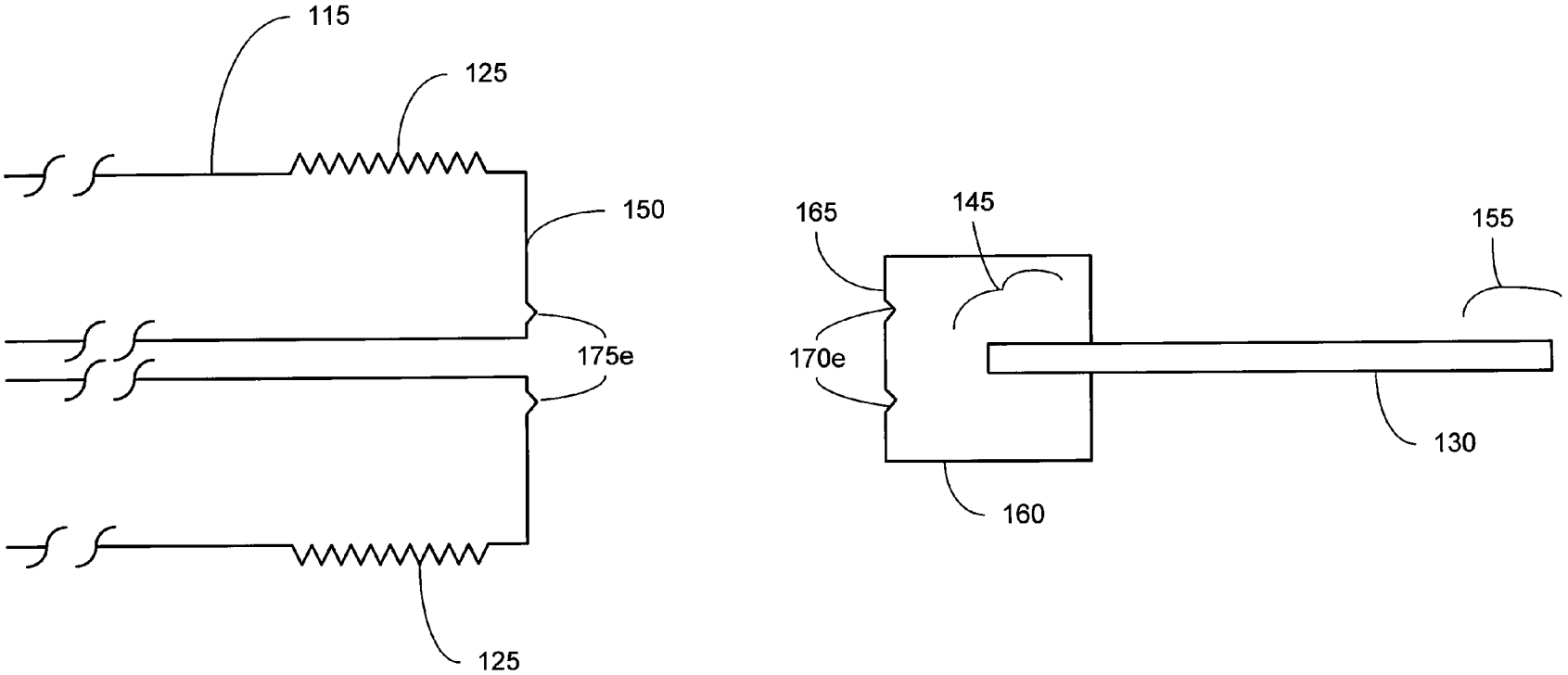
FIG. 1*d* shows a cross section of a sealing surface with a triangular cross sectioned ridge and a matching resurfacing head.
Figure 1E:
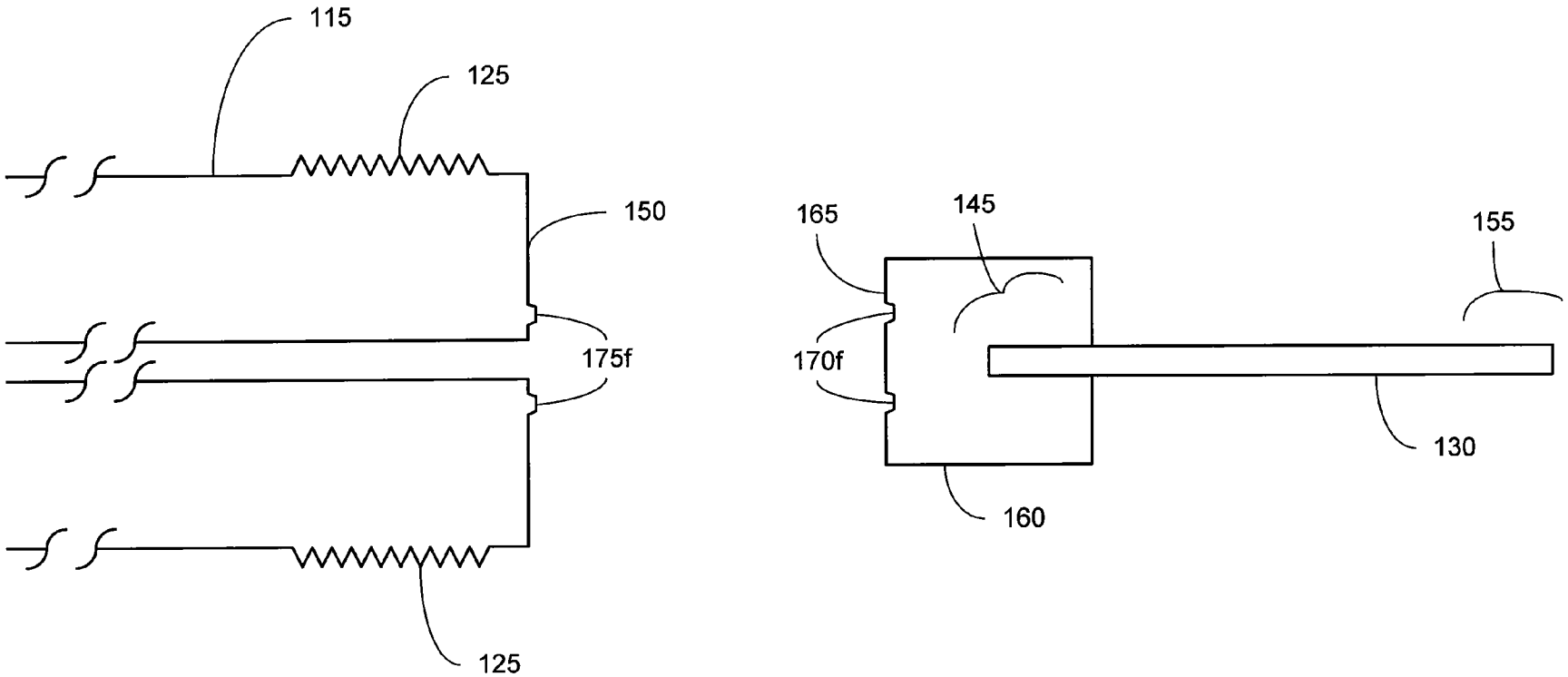
FIG. 1*e* shows a cross section of a sealing surface with a trapezoidal cross sectioned ridge and a matching resurfacing head.
Figure 1F:
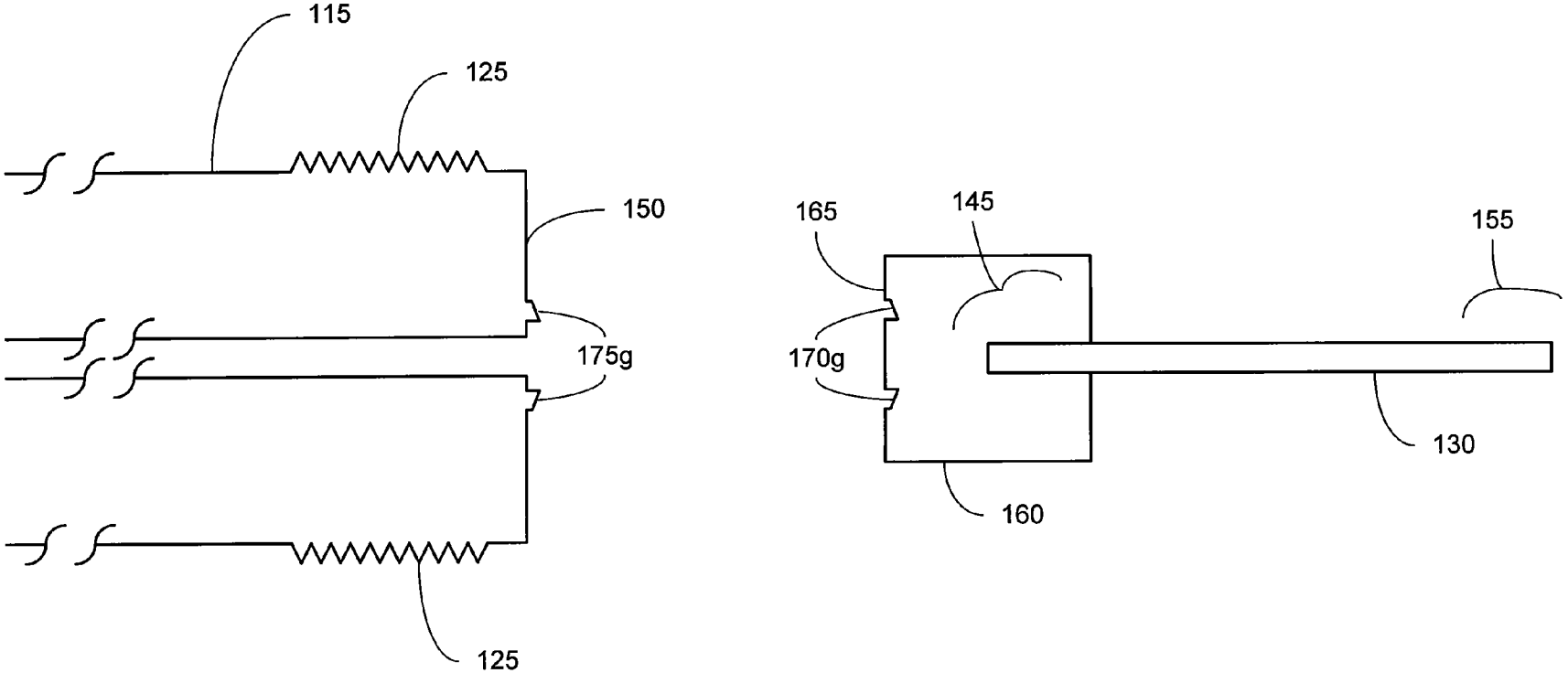
FIG. 1*f* shows a cross section of a sealing surface with a rhomboidal cross sectioned ridge and a matching resurfacing head.

FIG. 1*a* shows a cross section of a sealing surface 150 with a semi-elliptical cross sectioned ridge 175*b* and a matching resurfacing head 165 with semi-elliptical cross sectioned groove 170*a*. FIG. 1*b* shows a cross section of a sealing surface 150 with a different semi-elliptical cross sectioned ridge 175*c* and a matching resurfacing head 165 with semi-elliptical cross sectioned groove 170*c*. FIG. 1*c* shows a cross section of a sealing surface 150 with a rectangular cross sectioned ridge 175*d* and a matching resurfacing head 165 with rectangular cross sectioned groove 170*d*. FIG. 1*c* shows a cross section of a sealing surface 150 with a rectangular cross sectioned ridge 175*d* and a matching resurfacing head 165 with rectangular cross sectioned groove 170*d*. FIG. 1*d* shows a cross section of a sealing surface 150 with a triangular cross sectioned ridge 175*e* and a matching resurfacing head 165 with triangular cross sectioned groove 170*e*. FIG. 1*e* shows a cross section of a sealing surface 150 with a trapezoidal cross sectioned ridge 175*f* and a matching resurfacing head 165 with trapezoidal cross sectioned groove 170*f*. FIG. 1*f* shows a cross section of a sealing surface 150 with a rhomboidal cross sectioned ridge 175*g* and a matching resurfacing head 165 with rhomboidal cross sectioned groove 170*g*.

Figure 2:
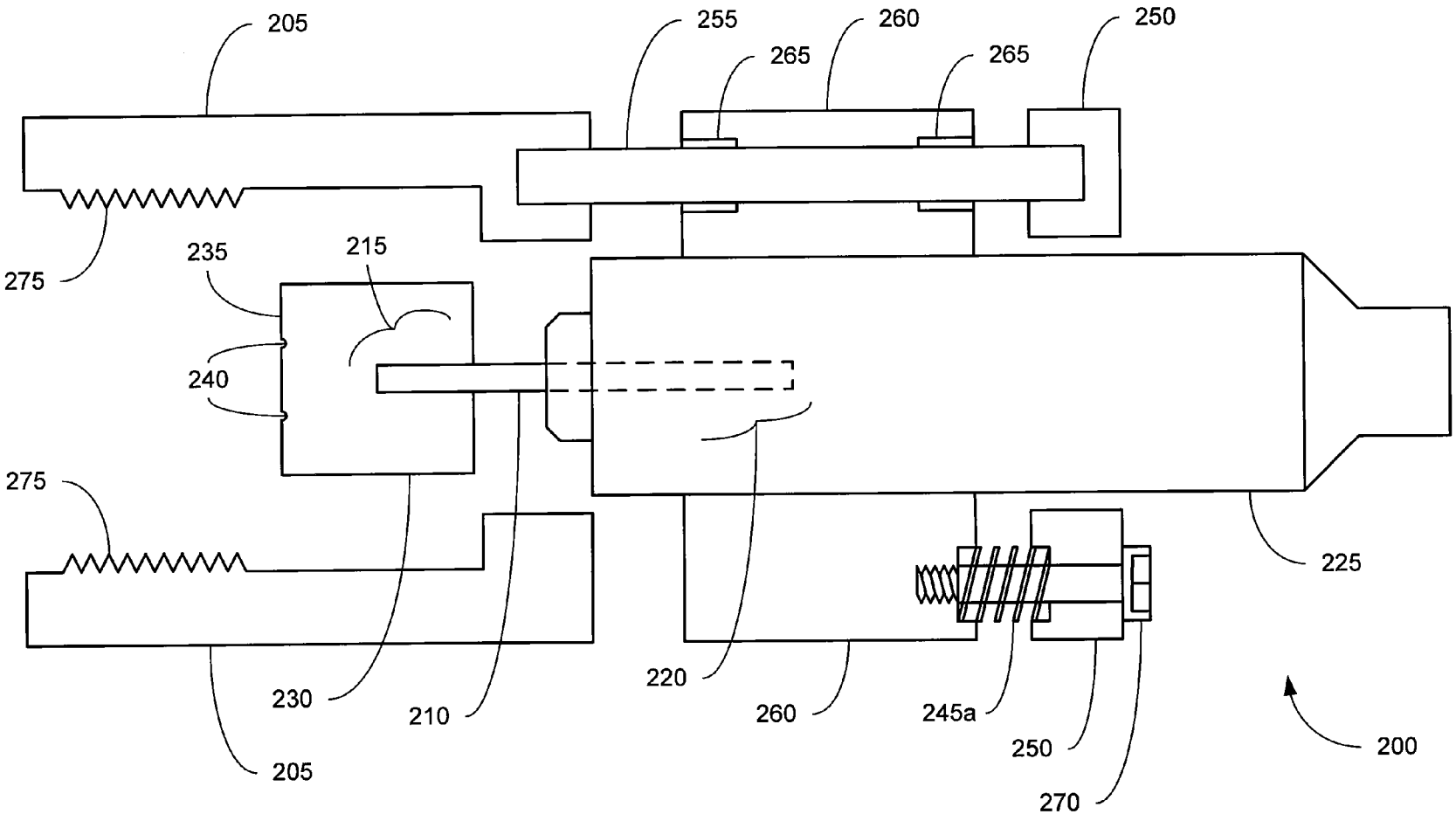
FIG. 2 shows a cross section of another possible tool embodiment of the invention which uses compression spring force producing elements and a rotational actuation device.

In FIG. 2, another block diagram cross section of a possible tool 200 embodiment of the invention is shown. The tool 200 consists of a housing 205 and an arbor 210 partially disposed in the housing. The arbor 210 is both rotationally and axially movable within the housing through a mechanism that will be described in more detail below. A first end 215 of the arbor 210 is proximal to a sealing surface as was the arbor 130 in FIG. 1. The fluid connector and the sealing surface are not shown in FIG. 2 so that the tool 200 may be shown with more clarity. The second end 220 of the arbor is adapted to receive a rotation actuation source, and in FIG. 2 is shown coupled with a rotational actuation source 225. As discussed above, the rotational actuation source, may for example, be an electric motor, a pneumatic motor, a water driven motor, a magnetic motor, a gas powered motor or engine, or a hydraulic motor.

A resurfacing head 230 is positioned at the first end 215 of the arbor 210. The resurfacing head 230 has a resurfacing face 235 adapted to contact the sealing surface of the connector. In this embodiment, the resurfacing face 235 is also shown having a resurfacing groove 240 with a semi-circular cross section. In other embodiments, the resurfacing face may not have a resurfacing groove 240, or may have a resurfacing groove 240 with a different cross section.

Figure 2A:
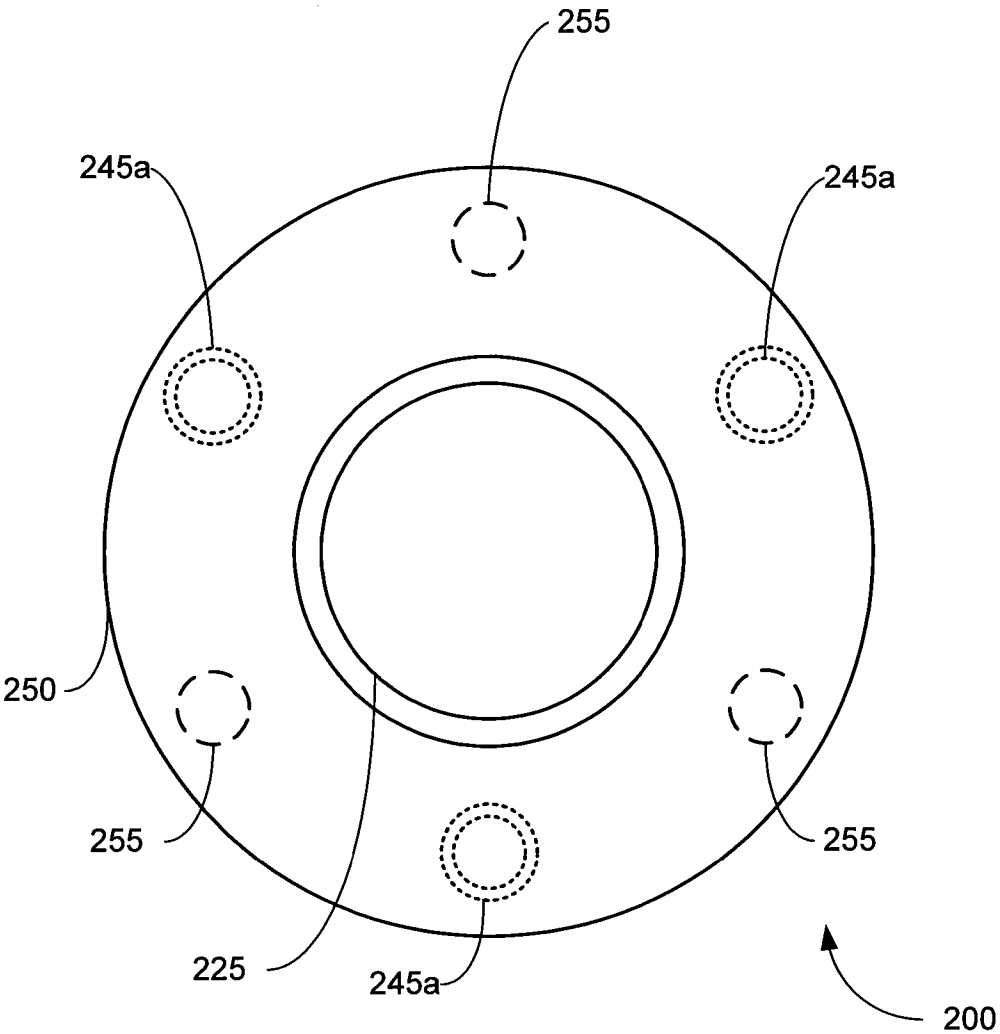
FIG. 2*a* shows a plan view of the tool from FIG. 2 from the rotational actuation source end.
Figure 2B:
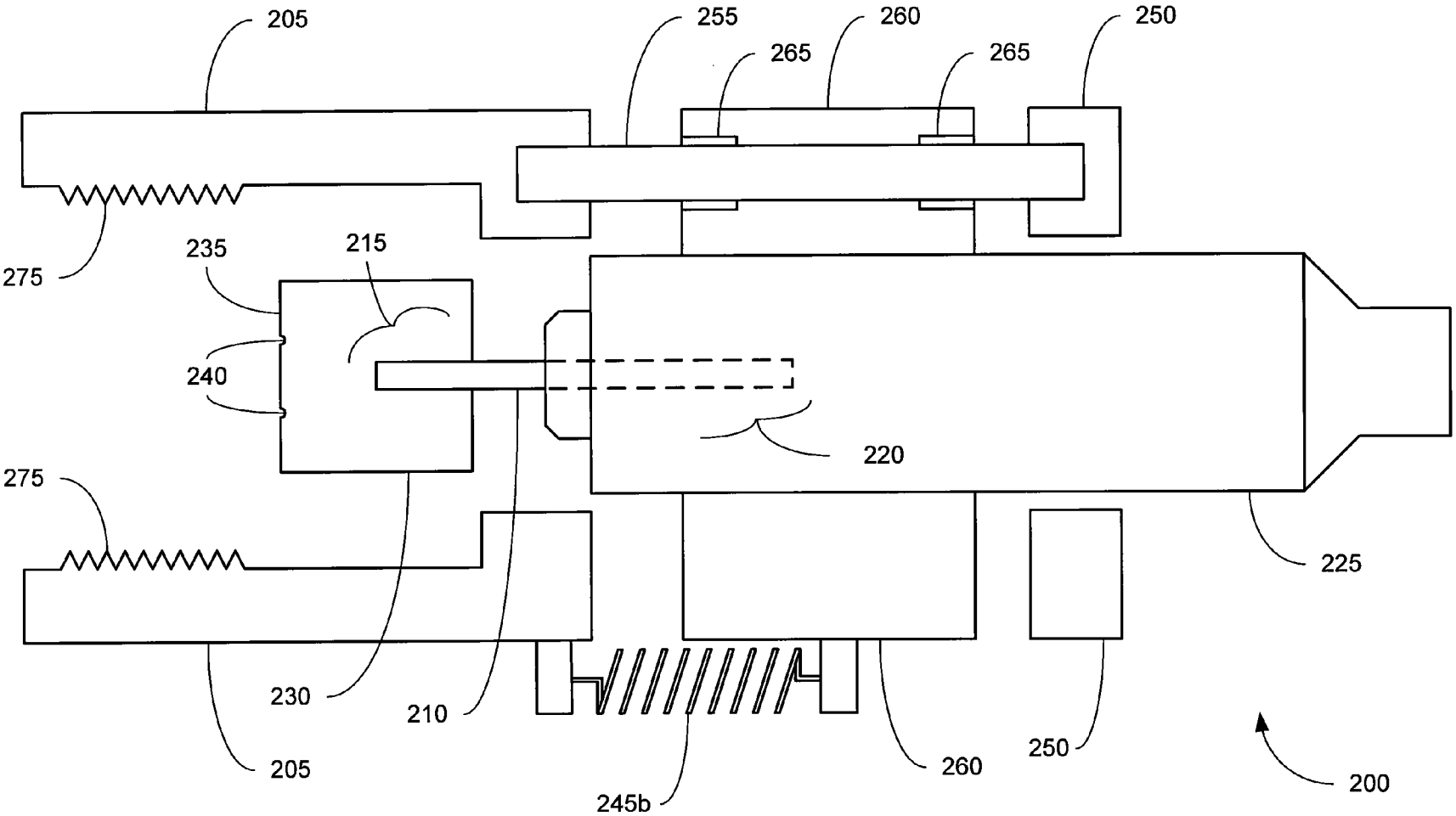
FIG. 2*b* shows a cross section of another possible tool embodiment of the invention which uses tension spring force producing elements and a rotational actuation device.
Figure 2C:
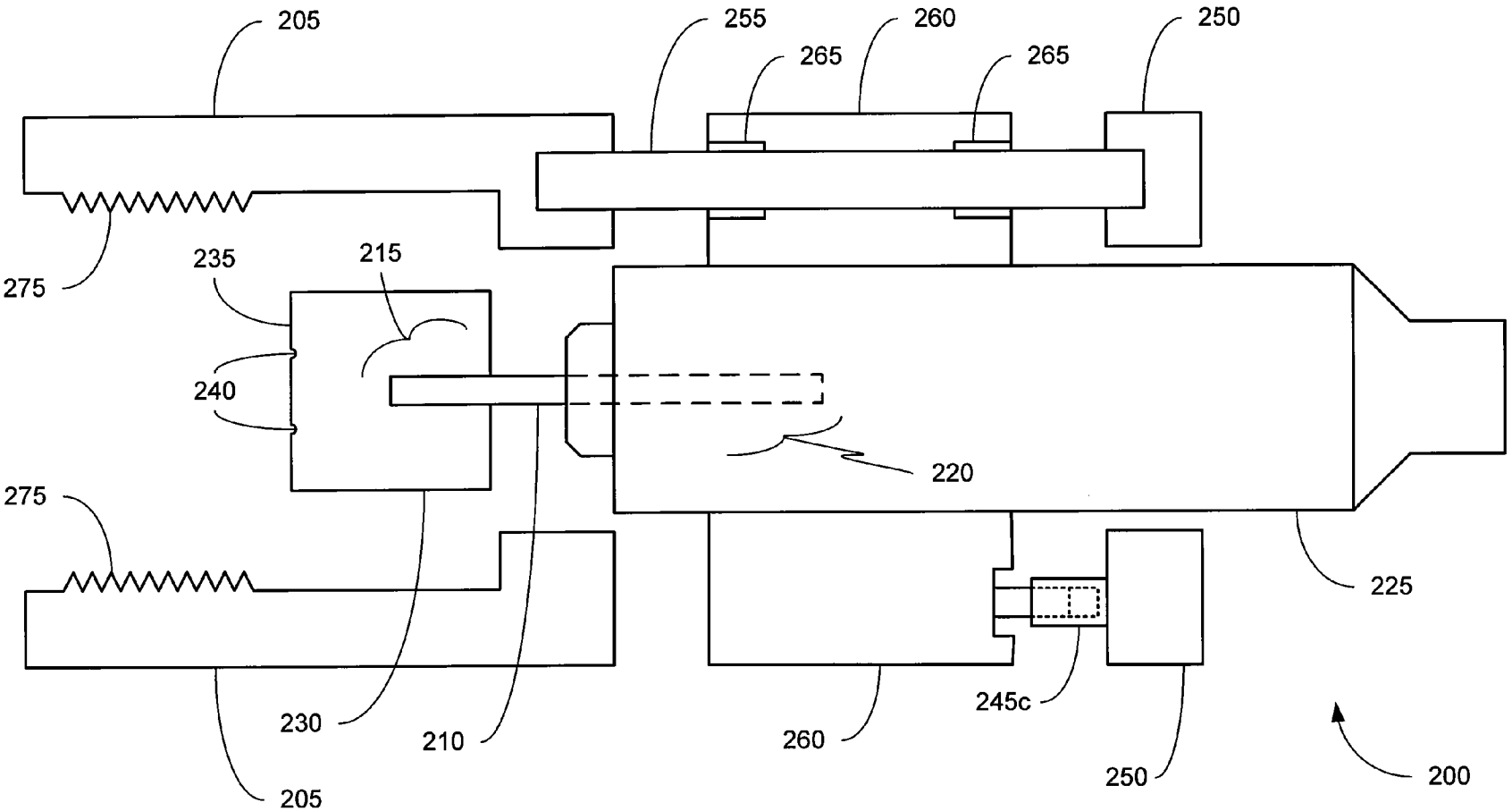
FIG. 2*c* shows a cross section of another possible tool embodiment of the invention which uses pneumatic or hydraulic cylinder producing elements and a rotational actuation device.

The tool 200 also has three force producing elements, shown here as compression springs 245*a*, coupled with the arbor 210 and the housing 205. Only one is shown in FIG. 2 because FIG. 2 is a cross section of the tool 200. In three dimensions, the tool 200 would have a spring 245*a* positioned at every 120 degrees surrounding the arbor 210 (see FIG. 2*a* for a plan view of tool 200 from the rotational actuation source 225 end). Typical springs used in some embodiments create a contact pressure between the resurfacing face 250 and the sealing surface of the fluid connector of about 0.001 pounds per inch to about 1000 pounds per inch force-per-deformation rates (e.g., about 0.1 psi to about 200 psi, about 15 psi, etc.). In other embodiments, any number of force producing elements may be used at varying positions surrounding the arbor 210. Also, other force producing elements besides compression springs 245*a* could be utilized as described above. For example, FIG. 2*b* shows tension springs 245*b* being used to provide the contact pressure. FIG. 2*c* shows hydraulic or pneumatic cylinders 245*c* providing the contact pressure The springs 245*a* are coupled with the housing 205 through a stationary ring 250 and three link rods 255. As with the springs 245*a*, only one link rod 255 is shown because FIG. 2 is a cross section of the tool 200. In three dimensions the tool 200 has a link rod 255 positioned at every 120 degrees surrounding the arbor 210. In other embodiments, any number of link rods 255 may be used at varying positions surrounding the arbor 210. Those skilled in the art will also now recognize other linkage mechanisms that could be used to achieve the same function as the link rods 255.

The springs 245*a* are also coupled with the arbor 210 through a rotational actuation source adapter 260 fixedly couple with the rotational actuation source 225. In this embodiment then, the rotational actuation source 225 and the housing 205 are coupled together such that the rotational actuation source 225 may only move relative to the housing 205 in a direction substantially perpendicular to the sealing surface when the housing 205 is coupled to a fluid connector. The rotational actuation source adapter 260 is configured to slide along the link rods 255 in this embodiment. Lubricated bushings 265 may be disposed within cavities in the rotational actuation source adapter 260 to encourage such movement. Additionally, screws 270 slideably disposed through the stationary ring also limit the types of movement of the rotational actuation source 225 relative to the housing 205, as well as serve to keep the springs 245*a* aligned with the tool 200.

When practicing some methods of the invention, the tool 200 would be coupled to a fluid connector using the machine threads 275 on the tool and corresponding machine threads on the fluid connector. Once coupled, the housing, 205 may keep the resurfacing head 230, resurfacing face 235, and the circular resurfacing groove 240 aligned with a sealing surface on the fluid connector and a circular ridge on the sealing surface. Additionally, coupling the housing 205 to the fluid connector will mate the sealing surface of the fluid connector to the resurfacing head 230 and consequently apply a force to the resurfacing head 230, which will be transmitted through the arbor 210, rotational actuation source 225, and rotational actuation source adapter 260 causing compression of the springs 245*a* or actuation of other force producing elements which may be employed in place of springs 245*a*.

The arbor 210 may then be rotated by the rotational actuation source 225 at its second end 220. When the rotational actuation source 225 is activated while the springs 245*a* are urging the resurfacing head 230 toward the sealing surface, the resurfacing face 235 and resurfacing groove 240 will resurface the circular ridge on the sealing surface. A polishing material, as described above, may be deposited on either the sealing surface 150 or the resurfacing face 165 to achieve an even smoother surface finish.

Figure 3:
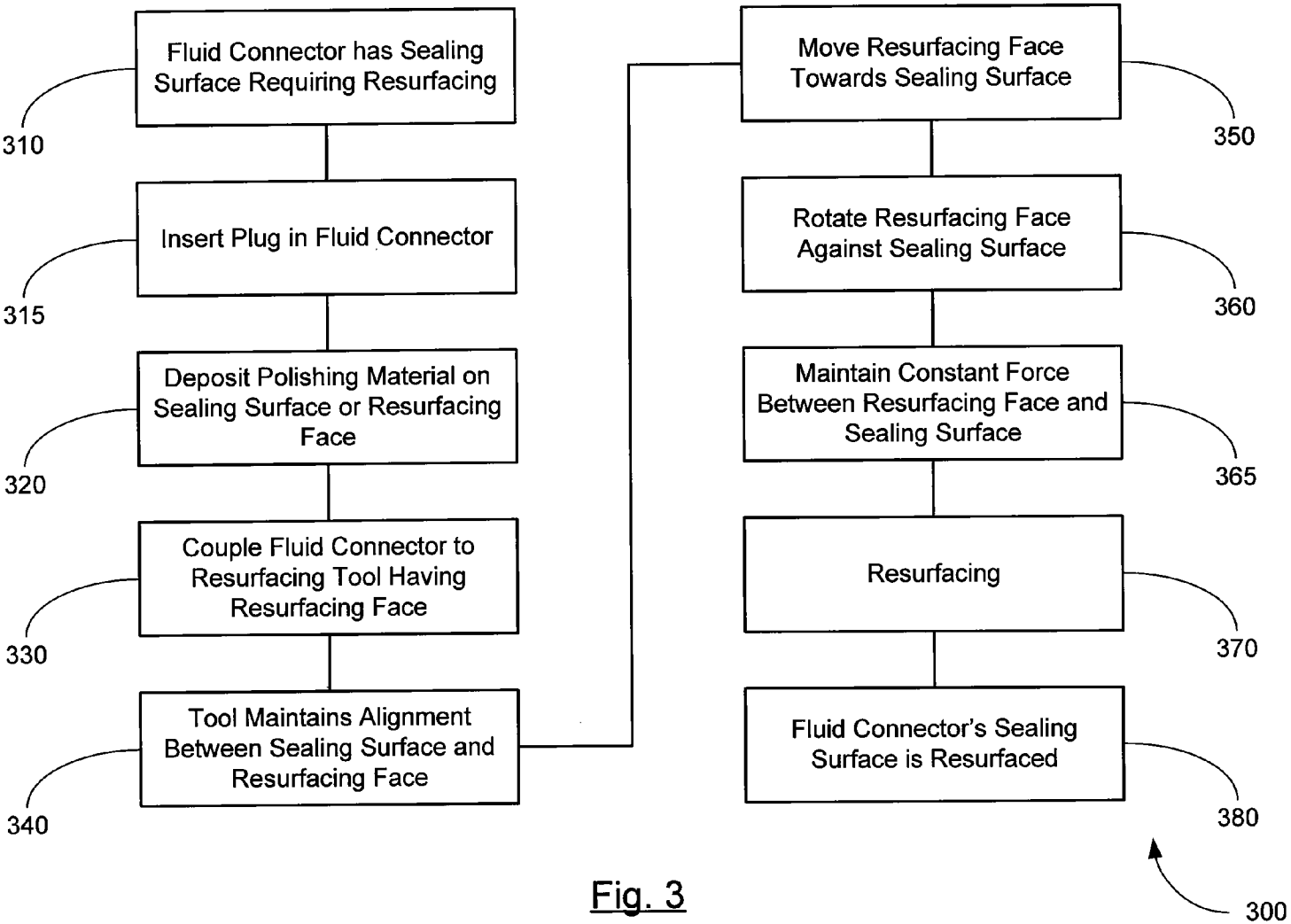
FIG. 3 shows a method embodiment of the invention that may be used to resurface a sealing surface with a circular ridge.

Turning now to FIG. 3, a flow chart of one possible method 300 of resurfacing a sealing surface of a fluid connector in a fluid delivery component is disclosed. At block 310, a fluid connector may be recognized as having a sealing surface that requires resurfacing. At block 320, a polishing material may be deposited on the sealing surface or resurfacing face of a tool that will be used to resurface the sealing surface. In some embodiments this step will not occur. At block 330 a fluid connector is decoupled from the fluid delivery component and coupled to the resurfacing tool having the resurfacing face. The decoupled fluid connector may still be attached to the fluid delivery component, and may remain attached to a larger system that is, for example, a semiconductor fabrication system. In other instances, the fluid connector may be detached from the fluid delivery component, in addition to being decoupled to provide access of the sealing surface to the resurfacing tool.

Embodiments of the method 300 may also optionally include inserting a plug into the fluid connector before coupling the connector to the resurfacing tool at block 315. The plug seals the connector opening and prevents particles and shavings generated by the resurfacing process from contaminating the fluid connector.

The plug may be made from an expandable and/or elastic material such as rubber, synthetic foam, cork, an elastomeric material, silicone, etc. The plug may also be made of a more rigid material, such as metal, with grooves that support an elastomeric o-ring. In embodiments where the fluid connector has a threaded orifice, the plug may also be threaded so that in can be screwed into the threaded opening of the connector. Embodiments may also include a threaded plug with a o-ring positioned above the threads that forms a seal with a lip of the fluid connector when the plug is screwed into the connector.

At block 340, and throughout some of the other steps of the method, the tool maintains alignment between the sealing surface and the resurfacing face. At block 350, the resurfacing face is moved toward the sealing surface. At block 360, the resurfacing face is rotated against the sealing surface. At block 365, a constant force may be applied by the resurfacing face against the sealing surface. This causes resurfacing of the sealing face to occur at block 370 for as long as the resurfacing face is rotated against the sealing surface. At block 380, the tool is uncoupled from fluid connector and the sealing surface is resurfaced.

Using this method and/or the tools disclosed above, a surface finish of about 0.001 μm Ra may be achieved on sealing surfaces described in this description, as well as other sealing surfaces known in the art. Typical sealing surfaces having a circular ridge with a semi-circular cross section may have leak rates of about $1\times10^{-3}$ cc/sec or less (e.g., about $1\times10^{-9}$ cc/sec or less, about $1\times10^{-9}$ cc/sec to about $1\times10^{-12}$ cc/sec, etc.) after resurfacing.

Having described several embodiments, it will be recognized by those of skill in the art that various modifications, alternative constructions, and equivalents may be used without departing from the spirit of the invention. Additionally, a number of well known processes and elements have not been described in order to avoid unnecessarily obscuring the present invention. Accordingly, the above description should not be taken as limiting the scope of the invention.

As used herein and in the appended claims, the singular forms "a", "an", and "the" include plural referents unless the context clearly dictates otherwise. Thus, for example, reference to "a process" includes a plurality of such processes and reference to "the electrode" includes reference to one or more electrodes and equivalents thereof known to those skilled in the art, and so forth.

Also, the words "comprise," "comprising," "include," "including," and "includes" when used in this specification and in the following claims are intended to specify the presence of stated features, integers, components, or steps, but they do not preclude the presence or addition of one or more other features, integers, components, steps, acts, or groups.

What is claimed is:

1. A device to resurface a sealing surface of a low-leak rate fluid connector that forms a leaktight seal with a metal gasket in a fluid delivery component, the device comprising:

a housing adapted to be reversibly coupled to the fluid connector;

an arbor at least partially disposed in the housing, and both rotationally and axially movable within the housing, wherein the arbor has a first end proximal to the sealing surface and a second end distal to the sealing surface and adapted to receive a rotational actuation source;

a resurfacing head positioned at the first end of the arbor and having a resurfacing face that includes a resurfacing groove adapted to fit a ridge on the sealing surface of the fluid connector that forms the leaktight seal with the metal gasket, wherein rotational contact between the groove and the ridge causes the resurfacing of the sealing surface such that the ridge forms a leaktight seal with the metal gasket at a leak rate of about $1\times10^{-3}$ cc/sec or less, and wherein the resurfacing head is formed integral with the arbor; and wherein the housing keeps the circular resurfacing groove and the circular ridge on the sealing surface aligned during the resurfacing.

2. The device of claim 1, wherein the resurfacing grove and the ridge on the sealing surface have a circular shape.

3. The device of claim 1, wherein the resurfacing groove and the ridge on the sealing surface have a semi-circular or semi-elliptical cross section.

4. The device of claim 1, wherein the resurfacing groove and the ridge on the sealing surface have a rectangular, triangular, trapezoidal, or rhomboidal cross section.

5. The device of claim 1, wherein the fluid connector is adapted to receive a gasket.

6. The device of claim 1, wherein the fluid delivery component is selected from the group consisting of:

a pipe;
a tube;
a cylinder valve;
a line valve;
a gas distribution component;
a coupling; and
a manifold.

7. The device of claim 6, wherein the gas distribution component is selected from the group consisting of a regulator, a mass flow controller, a particle filter, a purifier, and a pressure transducer.

8. The device of claim 1, wherein the housing is a single piece and the arbor is only disposed in the housing.

9. The device of claim 1, wherein a threaded coupling is used for the reversible coupling of the housing to the fluid connector.

10. The device of claim 1, wherein the rotational actuation source is selected from the group consisting of:

an electric motor;
a pneumatic motor;
a water driven motor;
a magnetic motor;
a gas powered motor; and
a hydraulic motor.

11. The device of claim 1, wherein the rotational actuation source is a drill.

12. The device of claim 1, wherein the rotational actuation source rotates the arbor at a rate of about 0.1 rpm to about 100,000 rpm.

13. The device of claim 1, wherein the rotational actuation source rotates the arbor at a rate of about 20 rpm to about 40,000 rpm.

14. The device of claim 1, wherein the resurfacing face comprises a material having a hardness greater than the sealing surface of the fluid connector.

15. The device of claim 1, wherein the resurfacing face has a hardness of about 1 or more on Mohs Scale of Hardness.

16. The device of claim 1, wherein the resurfacing face comprises one or more metal oxides

17. The device of claim 16, wherein the metal oxides comprise aluminum oxide, titanium oxide, ceramic aluminum oxide, emery, silicon oxide, or zirconia alumina.

18. The device of claim 1, wherein the resurfacing face comprises one or more carbide compounds.

19. The device of claim 18, wherein the carbide compounds comprise silicon carbide, or tungsten carbide.

20. The device of claim 1, wherein the resurfacing face comprises one or more nitride compounds.

21. The device of claim 20, wherein the nitride compounds comprise silicon nitride or boron nitride.

22. The device of claim 1, wherein the resurfacing face comprises one or more carbon containing compounds.

23. The device of claim 1, wherein the polishing material is deposited on the sealing surface or the resurfacing face, wherein a polishing material is selected from the group consisting of;

a lapping compound;

a polishing rouge;and an abrasive past.

24. The device of claim 23, wherein the polishing material Comprised metal oxide.

25. The device of claim 24, wherein the metal oxide comprises ferric oxide, aluminum oxide, or zirconium oxide.

26. The device of claim 23, wherein the polishing material comprises particles having an average particle size of about 40 grit to about 2000 grit.

27. The device of claim 1, wherein the housing further defines a bearing cavity, wherein a bearing is at least partially disposed in the bearing cavity, and the arbor is at least partially disposed in the bearing.

28. The device of claim 1, wherein the resurfaced sealing surface of the fluid connector has a leak rate of about $1\times10^{-9}$ cc/sec to about $1\times10^{-12}$ cc/sec.

29. A device to resurface a sealing surface of a low-leak rate fluid connector in a fluid delivery component, the device comprising:

a housing adapted to be reversibly coupled to the fluid connector;

an arbor at least partially disposed in the housing, and both rotationally and axially movable within the housing, wherein the arbor has a first end proximal to the sealing surface and a second end distal to the sealing surface and adapted to receive a rotational actuation source;

a resurfacing head positioned at the first end of the arbor and having a resurfacing face that includes a resurfacing groove adapted to fit a ridge on the sealing surface of the fluid connector that forms the leaktight seal with the metal gasket, wherein rotational contact between the groove and the ridge causes the resurfacing of the sealing surface such that the ridge forms a leaktight seal with the metal gasket at a leak rate of about $1\times10^{-3}$ cc/sec or less;

three force producing elements, wherein the three force producing elements are coupled with the housing and the resurfacing head, and are configured to urge the resurfacing head toward the sealing surface; and wherein the housing keeps the resurfacing face aligned with the sealing surface during the resurfacing.

30. The device of claim 29, wherein:

the sealing surface includes a circular ridge; and the resurfacing face has a circular groove that is adapted to fit the circular ridge when the resurfacing face contacts the sealing surface.

31. The device of claim 29, wherein the three force producing are selected from the group consisting of:

at least one pressurized pneumatic cylinder;

at least one pressurized hydraulic cylinder;

at least one helical compression spring; and at least one helical tension spring.

32. The device of claim 29, wherein the three force producing elements apply about 0.001 psi to about 1000 psi of contact force between the resurfacing head and the sealing surface of the fluid connector.

33. The device of claim 29, wherein the three force producing elements apply about 0.1 psi to about 200 psi of contact force between the resurfacing head and the sealing surface of the fluid connector.

34. The device of claim 29, further comprising the rotational actuation source.

35. The device of claim 29, wherein the housing and the rotational actuation source are coupled with each other such that the rotational actuation source may only move relative to the housing in a direction substantially perpendicular to the sealing surface.

36. The device of claim 29, wherein the resurfacing face comprises a material with a hardness greater than the hardness of the sealing surface of the fluid connector.

37. The device of claim 29, wherein the resurfacing face comprises a metal oxide, a metal nitride, a metal carbide, or a covalent network solid.

38. The device of claim 37, wherein the covalent network solid is diamond.

39. A method of resurfacing a sealing surface of a fluid connector in a fluid delivery component, the method comprising the steps of:

coupling the fluid connector to a resurfacing device comprising a rotatable resurfacing face that includes a circular resurfacing groove adapted to contact a circular ridge on the sealing surface of the fluid connector;

moving the resurfacing face towards the sealing surface with three force producing elements; and rotating the resurfacing groove against the ridge on the sealing surface to cause the sealing surface to be resurfaced, wherein the resurfaced sealing surface of the fluid connector has a leak rate of about $1\times10^{-3}$ cc/sec or less and, wherein the groove and the ridge are kept aligned by the resurfacing device.

40. The method of claim 39, wherein a rotational actuation source is used to rotate the resurfacing groove against the ridge on the sealing surface.

41. The method of claim 39, wherein the rotational actuation source is selected from the group consisting of:

an electric motor;

a pneumatic;

a water driven motor;

a magnetic motor;

a gas powered motor; and a hydraulic motor.

42. The method of claim 39, wherein the resurfacing grove is rotated against the ridge on the sealing surface at a rate of about 0.1 rpm to about 100,000 rpm.

43. The method of claim 39, wherein the method further comprises maintaining a substantially constant contact force between the resurfacing face and the sealing surface during the resurfacing with the three force producing elements.

44. The method of claim 43, wherein the three force producing elements provide a translational force to move the resurfacing face towards the sealing surface of the fluid connector.

45. The method of claim 43, wherein the three force producing elements are selected from the group consisting of:

a pressurized pneumatic cylinder;

a pressurized hydraulic cylinder;

a helical compression spring; and a helical tension spring.

46. The method of claim 39, wherein the three force producing elements maintain the contact force between the resurfacing face and the sealing Surface at about 0.001 psi to about 1000 psi.

47. The method of claim 39, wherein the resurfacing face comprises a material with a harness greater than the hardness of the sealing surface of the fluid connector.

48. The method of claim 39, wherein the resurfacing face comprises a metal oxide, a metal nitride, a metal carbide, or a covalent network solid.

49. The method of claim 48, wherein the covalent network solid is diamond.

50. The method of claim 39, wherein the method further comprises depositing a polishing material on the sealing surface or the resurfacing face, wherein the polishing material is selected from the group consisting of:

a lapping compound;

a polishing rouge; and an abrasive paste.

51. The method of claim 39, wherein the resurfaced sealing surface of the fluid connector has a leak rate of about 1×10−9 cc/sec to about 1×10−12 cc/sec.

52. The method of claim 39, wherein the fluid delivery component is part of a system to manufacture semiconductor devices.

53. The method of claim 39, wherein the method further comprises inserting a plug in the fluid connector to prevent particles from the sealing surface from contaminating the connector.

54. The method of claim 53, wherein the plug comprises an expandable material.

55. The method of claim 53, wherein the plug is threaded and has an o-ring that forms a seal when inserted into the connector.

56. A method of resurfacing a sealing surface of a fluid connector in a fluid delivery component, the method comprising the steps of:

coupling the fluid connector to a resurfacing device comprising a housing and an arbor at least partially disposed in the housing, and both rotationally and axially movable within the housing, wherein the arbor has a first end proximal to the sealing surface of the fluid connector and a second end distal to the sealing surface and adapted to receive a rotational actuation source;

activating at least one force producing element in the resurfacing device to urge a resurfacing head positioned at the first end of the arbor into contact with the sealing surface of the fluid connector, wherein the resurfacing head is formed integral with the arbor, and wherein the resurfacing head comprises a circular resurfacing groove adapted to contact a ridge on the sealing surface, and also wherein the activation of the rotational activation source cases the ridge to be resurfaced by the resurfacing groove; and activating at least one rotational actuation source to rotate the resurfacing head and cause the sealing surface of the fluid connector to be resurfaced, wherein the resurfaced sealing surface of the fluid connector has a leak rate of about $1\times10^{-3}$ cc/sec or less and, wherein the housing keeps the resurfacing head aligned with the sealing surface.

57. The method of claim 56, wherein the force producing element maintains a substantially constant contact force between the resurfacing head and the sealing surface of the fluid connector during the resurfacing.

58. The method of claim 56, wherein the fluid connector remains attached to the fluid delivery component during the resurfacing of the sealing surface.

59. The method of claim 56, wherein the ridge and the resurfacing groove are kept in alignment by the housing of the resurfacing device.

60. The method of claim 56, wherein the method farther comprises providing a polishing material to a surface of the resurfacing head that makes contact with the sealing surface of the fluid connector.

61. The method of claim 56, wherein the polishing material comprises a lapping compound, a polishing rouge, or an abrasive paste.

62. The method of claim 56, wherein the force producing element is selected from the group consisting of:

a pressurized pneumatic cylinder;

a pressurized hydraulic cylinder;

a helical compression spring; and a helical tension spring.

63. The method of claim 56, wherein the force producing element maintains a contact force between the resurfacing face and the sealing surface of about 0.00 1 psi to about 1000 psi.

64. The method of claim 56, wherein the rotational actuation source is selected from the group consisting of:

an electric motor;

a pneumatic motor;

a water driven motor;

a magnetic motor;

a gas powered motor; and a hydraulic motor.

65. The method of claim 56, wherein the rotational actuation source rotates the resurfacing head against the sealing surface at a rate of about 0.1 rpm to about 100,000 rpm.

66. The method of claim 56, wherein the fluid delivery component is part of a system to manufacture semiconductor devices.

67. The method of claim 56, wherein the method further comprises inserting a plug in the fluid connector to prevent particles from the sealing surface from contaminating the connector.

* * * * *

UNITED STATES PATENT AND TRADEMARK OFFICE

CERTIFICATE OF CORRECTION

PATENT NO. : 7,662,026 B2
APPLICATION NO. : 11/679757
DATED : February 16, 2010
INVENTOR(S) : Jeffrey Alan Lewis It is certified that error appears in the above-identified patent and that said Letters Patent is hereby corrected as shown below:

Claim 23, Column 11, Line 5, delete "the polishing" and insert -- a polishing --

Claim 23, Column 11, Line 7, delete "a polishing" and insert -- the polishing --

Claim 23, Column 11, Line 11, delete "past" and insert -- paste --

Claim 24, Column 11, Line 13, delete "Comprised" and insert -- comprises --

Claim 41, Column 12, Line 41, after *a pneumatic* please insert -- motor --

Claim 46, Column 12, Line 66, delete "Surface" and insert -- surface --

Claim 47, Column 13, Line 2, delete "harness" and insert -- hardness --

Claim 60, Column 14, Line 16, delete "farther" and insert -- further --

Signed and Sealed this

Thirteenth Day of April, 2010

David J. Kappos

David J. Kappos
*Director of the United States Patent and Trademark Office*